United States Patent [19]

Iversen et al.

[11] Patent Number: 5,056,127

[45] Date of Patent: Oct. 8, 1991

[54] ENHANCED HEAT TRANSFER ROTATING ANODE X-RAY TUBES

[76] Inventors: Arthur H. Iversen, 15315 Sobey Rd., Saratoga, Calif. 95070; Stephen Whitaker, 409 11st., Davis, Calif. 95616

[21] Appl. No.: 487,137

[22] Filed: Mar. 2, 1990

[51] Int. Cl.[5] ..... H01J 35/10

[52] U.S. Cl. ..... 378/130; 165/80.4; 165/142; 378/129

[58] Field of Search ..... 165/142, 80.4; 378/125, 378/127, 129, 130, 141, 142, 144, 199, 200

[56] References Cited

U.S. PATENT DOCUMENTS 4,405,876 9/1983 Iversen ..... 313/30
4,622,687 11/1986 Whitaker et al. ..... 378/130
4,694,378 9/1987 Nakayama et al. ..... 357/82

*Primary Examiner*—Edward P. Westin
*Assistant Examiner*—David P. Porta
*Attorney, Agent, or Firm*—Streich Lang

[57] ABSTRACT

Means for enhancing heat transfer from liquid cooled rotating anode x-ray tubes that provide for extended surfaces on the liquid cooled concave curved heat exchange surfaces opposing the electron beam focal track. The extended surfaces take the form of fins lying in the direction of coolant flow, said fins preferably being generally triangular in cross section.

10 Claims, 2 Drawing Sheets

ENHANCED HEAT TRANSFER ROTATING ANODE X-RAY TUBES

TECHNICAL FIELD

Devices and x-ray tubes including surfaces comprising a heated surface and a generally opposing liquid cooled surface heat exchange surface concavely curved in the direction of liquid flow, and extended surfaces are prepared on said heat exchange surface in the direction of coolant flow to further enhance heat transfer.

BACKGROUND

In the liquid cooling of heated surfaces operating at high heat fluxes, the required liquid velocities to avoid film boiling can be quite high. The result is that large pumps and high pressures are required. By employing concavely curved heat exchange surfaces two phase, i.e. boiling, heat transfer can be increased as compared to linear flow. It is desirable to further enhance heat transfer from concave curved heat exchange surfaces whereby even higher critical heat fluxes may be obtained.

SUMMARY OF THE INVENTION

The present invention provides for the enhancement of two phase heat transfer from a concavely curved heat exchange surface.

The present invention further provides for the inexpensive manufacture of liquid cooled rotating anodes for x-ray tubes that may incorporate extended surface heat exchange surfaces of complex geometry.

DETAILED DESCRIPTION OF THE PREFERRED EXEMPLARY EMBODIMENT

For the purposes of the present invention and as used in the specifications and claims, the term fin or fins is used to describe an extended or enhanced surface that increases the wetted surface area of a heat exchange surface that is liquid cooled. Those extended surfaces that are thicker at the base attached to the heat transfer surface and become thinner as they extend from said heat transfer surface are described as triangular or generally triangular even when the wetted fin surface is curved, or otherwise shaped.

The present invention provides for the enhancement of heat transfer employing subcooled nucleate boiling at concavely curved heat transfer surfaces where radial acceleration, $v^2/r$, can be used to develop significant and beneficial buoyancy forces. These buoyancy forces, by more rapidly propelling the nucleate bubbles directly from the heat transfer surface as well as by reducing the nucleate bubble size can significantly increase the critical heat flux.

Figure 1:
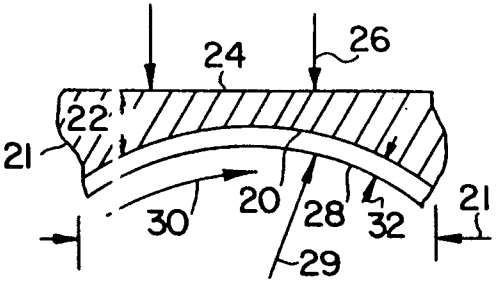
FIG. 1 is a cross section view in a plane of coolant flow of a concavely curved heat exchange surface prepared with fins in the direction of coolant flow.

FIG. 1 illustrates a concavely curved heat exchange surface 20 of device 21 with varying wall thickness 22 and having a heated opposing surface 24 upon which energy 26 is delivered by various means including energy beams such as electromagnetic, positive, e.g., ions, negative, e.g. electrons or neutral. Other sources of heat 26 may be by sources mounted on surface 24 such as semi-conductor devices, resistors etc. with heat transmitted conductively. The solidification of molten material on surface 24 is yet another source of heat 26. Device 21 may be stationary or may be in movement as in a liquid cooled rotating anode x-ray tube or rotating chill wheel as employed in the rapid solidification of metals. Extended surfaces of generally uniform height 32 in the form of fins 28 lying in the direction of coolant flow 30 are provided on heat exchange surface 20. The length of fins 28 in all embodiments extend substantially along the length 21 of heat exchange surface 20 opposing heated surface 24.

Figure 2:
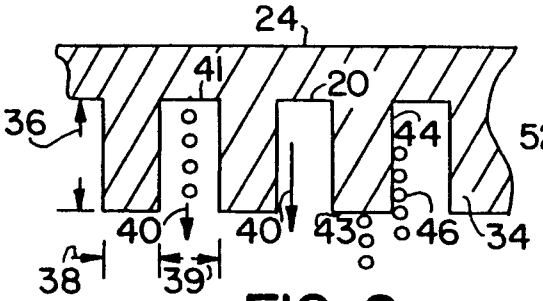
FIG. 2 is a cross section view of fins of rectangular cross section in a plane orthogonal to the direction of coolant flow.

In a plane orthogonal to coolant flow 30, FIG. 2 illustrates rectangular fins 34 of height 36, width 38 and spacing 39. The centrifugal force, $a=v^2/gr$, where v is the coolant velocity, r is the radius of curvature 29 (FIG. 1) of curved heat exchange surface 20 and g or "gee"is one gravity gives rise to a buoyancy force 40, FIG. (2) that accelerates the nucleate bubbles 46 radially away from the heat exchange surface 20. With rectangular fins 34, the walls 44 are parallel to the buoyancy force 40 thereby tending to drive the bubbles 46 emerging from walls 44 along the walls 44. As the critical heat flux is approached, the bubbles 46 driven along walls 44 interfere with emerging nucleate bubbles further up the wall and can thereby cause premature coalescence of bubbles with consequent early film boiling and burn out. Bubbles emerging from troughs 41 and top surfaces 43 of fins 34 generally do not encounter this problem. Bubble 46 movement from surface 44 is by dispersive transport.

Figure 3:
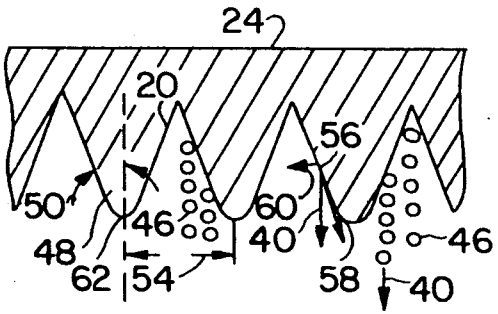
FIG. 3 is a cross section view of generally triangular fins in a plane orthogonal to the direction of coolant flow.

In FIG. 3, again in a plane orthogonal to the coolant flow 30, are shown fins of generally triangular cross section 48 and of half angle 50, height 52 and pitch 54. As can be seen here, the flow of nucleate bubbles 46 from wall 56 is substantially unimpeded. The smaller angle 50 is the greater the effective increase in heat exchange area. However, as angle 50 approaches zero the wall 56 lies along a radius as in FIG. 2 where bubbles tend to interfere with emerging bubbles along wall 56. Buoyancy force 40 may be broken into component 58 parallel to wall 56 and component 60 perpendicular to wall 56. Force 60 drives the bubbles directly away from wall 56 and is proportional to the sine of angle 50. Thus, there is an optimum angle 50 as well as height 52 which balances the increase in heat exchange surface area with nucleate bubble dynamics thereby providing maximum heat flux. Bubble diameter, $Bd \sim 1/(a)^{\frac{1}{2}}$ where a is the "gee" force. For example, at 100 "gees", the bubble diameter is 1/10 that at 1 "gee". Thus, the probability of bubble collision and coalescence is reduced accordingly. In this manner even shallow angle 50 triangular fins can be profitably employed. In general the tips 62 of triangles 48 are not pointed, but may be flat, rounded, etc.

Figure 4:
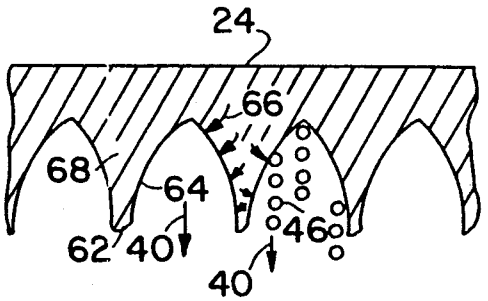
FIG. 4 is a cross section view of generally triangular fins in a plane orthogonal to the direction of coolant flow.

A further desirable embodiment in fins 68 for curved surface cooling employs curved fin surfaces 64, FIG. 4. Alternatively, a fin with a combination of linear and curved surfaces or multiple linear segments may be employed. Curved surfaces 64 permit an optimum fin thickness profile to be specified, matching it to decreasing heat flow as the tip of the fin 62 is approached. In general, fins will have height, width, pitch and spacings ranging from 0.1 mm to 3 mm. For triangular geometries, the effective, e.g. average, half angles will range from 1° to 45°.

Figure 5:
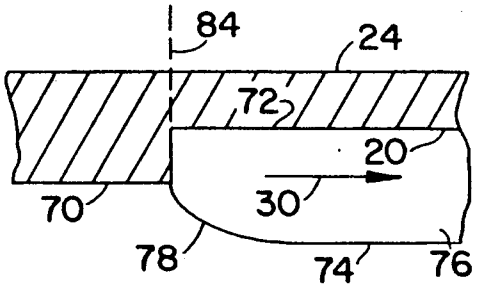
FIG. 5 is a cross section view of fins in a plane containing the direction of coolant flow illustrating streamlining of fin geometry to minimize undesirable fluid flow characteristics.
Figure 6:
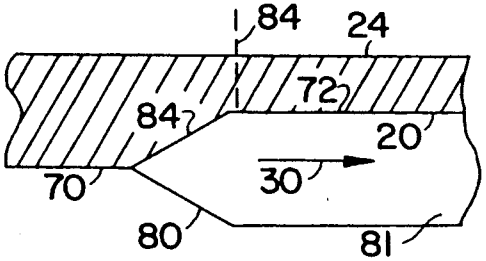
FIG. 6 is a cross section view of fins in a plane containing the direction of coolant flow illustrating streamlining of fin geometry to minimize undesirable fluid flow characteristics.

FIG. 5 is a cross section view in a plane containing the direction of coolant flow 30 illustrating the conduit cross section as being maintained substantially constant by having conduit surface 70 intermediate between the troughs 72 (surface 20) and peaks 74 of fins 76. This construction may be employed in FIGS. 2, 3 and 4. This serves to minimize undesirable flow characteristics such as cavitation as might be generated by abrupt changes in conduit cross section. Further optimization of flow characteristics may be obtained by tapering 78 the fins to smoothly meet conduit surface 70. Tapering of fin 76 is shown in the vertical plane and may also be employed in the horizontal plane. For improved heat transfer characteristics, FIG. 6, the tapered section 80 may also be incorporated on fin 81 surfaces above 82 and below 84 conduit surface 70. In general, the heat transfer surface 20 commences where fins 76 (FIG. 5) and 81 (FIG. 6) are substantially fully developed 84.

Fins may be prepared on the heat exchange surfaces, for example, mechanically by grinding or chemically by etching, e.g. chemical milling. With etching technique, rectangular fins are obtained without undercutting the photo resist, whereas with triangular or curved fins, controlled undercutting is employed. Nucleating cavities of optimum geometry and placement may be prepared on the finned surfaces 44, 56 and 64 as well as on heat exchange surfaces 20 to further enhance heat transfer.

Figure 7:
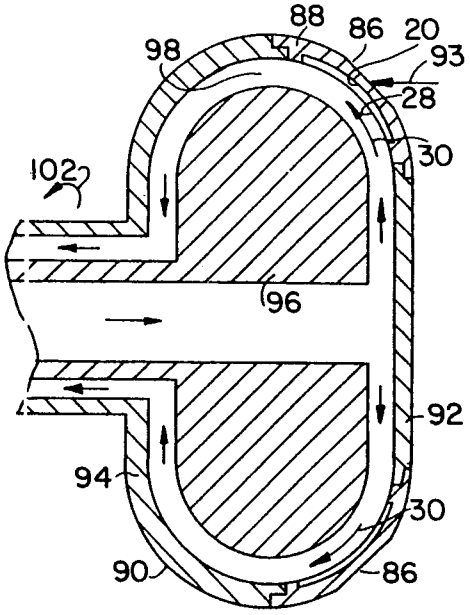
FIG. 7 is a cross section view of a liquid cooled rotating anode x-ray tube illustrating incorporation of extended surfaces on liquid cooled concavely curved heat exchange surfaces.

A preferred embodiment of the present invention is shown in FIG. (7) wherein extended surfaces are employed at the liquid cooled heat exchange surface of a rotating structure. Examples of rotating structures include rotating anode x-ray tubes and rotating chill wheels for rapid solidification of molten materials, e.g. metals and ceramics. As illustrated in FIG. 7, the heat exchange surface 20 is provided with fins 28 that lie in the direction of coolant flow 30 thereby providing an extended surface for increased heat transfer.

In general, for imaging applications the x-ray tube anode focal track surface 86, which is illuminated by an electron beam 93, is made from materials such as tungsten, tungsten 3–10% rhenium, molybdenum, copper and various copper alloys etc. To provide a finned surface on complex curved surface 20 presents fabrication difficulties. To facilitate fabrication, the anode focal track structure 88 may be made by the chemical vapor deposition (CVD) technique.

Figure 9:
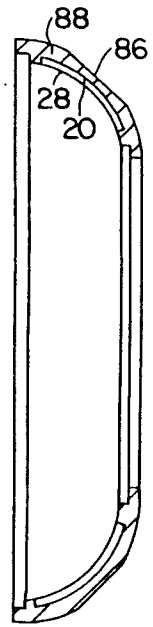
FIG. 9 is a cross section view of the anode focal track structure in a plane containing the direction of coolant flow.

To fabricate the anode focal track structure 88 (FIGS. 8, 9), a form (not shown) is made that is the inverse of the desired geometry of the focal track; that is, where the focal track structure 88 is concave 20, the form is convex and of the same radius of curvature, and, in like manner, the fins are formed. On this heated form, the desired metal or metals will be deposited from gases by the CVD process. The metal deposited on the form might comprise 97% tungsten, 3% rhenium from a suitable combination of gases containing tungsten and rhenium. Upon completion of the CVD process, the resulting focal track structure 88 complete with fins 28 on the curved liquid cooled side is removed from the form.

Figure 8:
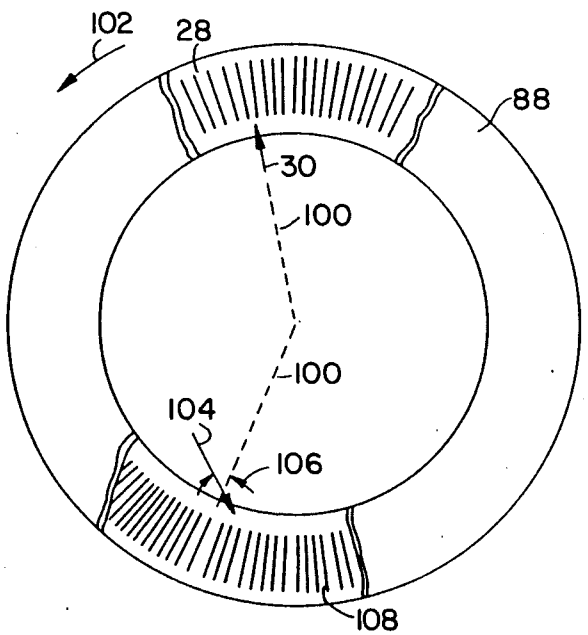
FIG. 8 is a front view of the concave curved liquid cooled heat exchange surface of the anode focal track structure incorporating fins.
Figure 10:
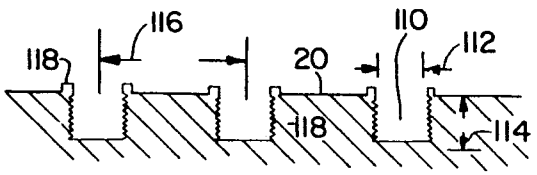
FIG. 10 is a cross section view of a concave curved heat exchange surface with nucleating cavities of optimum geometry and placement.

In FIG. 8 the coolant flow 30 is shown as radial 100 and fins 28 are substantially radial in position. This occurs when the coolant 30 rotates 102 substantially with the anode. When the coolant rotational velocity, with respect to the anode velocity 102, is different, the resultant coolant direction 104 will make an angle 106 with radius 100. Fins 108 are then placed substantially at angle 106 thereby placing coolant flow 104 substantially parallel to fins 108.

To reduce manufacturing costs, anode focal track structure 88 may be CVD fabricated without fins 28 or 108.

To incorporate the focal track structure 88, which is illuminated by electron beam 93, into the anode 90 of FIG. (7) end plates 92 and 90 are brazed, welded etc. to the focal track structure 88 to complete the anode structure 90. End plates 92, 94 and septum 96 are shaped to provide desired coolant conduit 98 geometry. For a good coefficient of expansion match to the tungsten rhenium focal track structure 88, end plates 92, 94 may be made from molybdenum.

To further enhance heat transfer from the extended heat transfer surface 20, 28, nucleating sites of optimum geometry and placement may be employed. Heat exchange is enhanced by the preparation of nucleating site cavities 110 on the heat exchange surface 20, 28 that are of optimum dimensions 112, 114 and spacing 116 such that at maximum heat flux the cavities are spaced sufficiently far apart 116 that the nucleate bubbles do not coalesce to form film boiling. Factors affecting bubble size and therefore spacing include surface tension, viscosity, temperature etc. Thus, maximum bubble production is obtained while minimizing the risk of film boiling. Cavity dimensions 112, 114 may range from 0.002 mm to 0.2 mm and spacing 116 between cavities on the heat exchange surface may range from 0.03 mm to 3 mm. This specified geometry of nucleating cavity dimensions and spacing between cavities may be achieved chemically by chemical milling, electronically by lasers, electron beams or electric discharge texturing (EDT) a varient of electric discharge machining (EDM), or mechanically by drilling, hobbing, etc. The inside surfaces of the cavities serving as nucleating sites are further prepared with microcavities 118, preferably reentrant, with dimensions in the range of $10^{-4}$ to $10^{-2}$ mm. Microcavities may be prepared, for example, by laser drilling, electron beam drilling or EDT in the presence of a reactive gas or liquid that creates a porous structure or microcavities in and around the cavities.

A further method to provide nucleating sites on the liquid cooled surface 20 and fins, if employed, of the focal track structure 88 is to control the CVD process such that during the initial deposition process, a specified porosity is achieved for a specified depth. Thereafer CVD deposition proceeds with the normal technique so as to provide a vacuum tight structure. Pore sizes may range from 0.001 mm to 0.1 mm and depth of porosity may range from 0.01 mm to 1 mm.

We claim:

1. A heat sink structure, comprising:

a heated surface;

a heat exchange surface on the interior surface thereof;

means for enclosing said heat exchange surface in a fluid tight manner;

means for providing a flow of coolant fluid to remove heat from said heat exchange surface, said heat exchange surface being concavely curved in the direction of said flow; and at least one fin formed on said heat exchange surface, said fin being of generally triangular cross section and extending in the direction of coolant flow substantially the length of said heat exchange surface.

2. The apparatus of claim 1 including a plurality of fins, wherein said fins have heights, widths and spacings ranging from 0.1 mm to 3 mm, and effective half angles ranging from 1° to 45°.

3. The apparatus of claim 1 wherein said apparatus is formed of at least one metal from the group comprising tungsten, rhenium, molybdenum, copper and alloys of copper.

4. In the apparatus of claim 3 including a plurality of fins, wherein said fins have heights, widths and spacings ranging from 0.1 mm to 3 mm, and effective half angles ranging from 1° to 45°.

5. The apparatus of claim 1 wherein said heat exchange surface is prepared with cavities, said cavities having dimensions in the range of 0.002 mm to 0.2 mm and being spaced apart on said heat exchange surface, said spacing generally ranging from 0.03 mm to 3 mm whereby more efficient heat transfer is obtained.

6. The apparatus of claim 3 wherein said heat exchange surface is prepared with cavities, said cavities having dimensions in the range of 0.002 mm to 0.2 mm and being spaced apart on said heat exchange surface, said spacing generally ranging from 0.03 mm to 3 mm whereby more efficient heat transfer is obtained.

7. The apparatus of claim 5 wherein said cavities are prepared with micro-cavities having dimensions ranging from $10^{-4}$ to $10^{-2}$ mm.

8. The apparatus of claim 6 wherein said cavities are prepared with micro-cavities having dimensions ranging from $10^{-4}$ to $10^{-2}$ mm.

9. The apparatus of claim 1 wherein said heat transfer surface is prepared with pores for a prescribed depth.

10. The apparatus of claim 9 wherein said pores have sizes ranging from 0.01 mm to 0.1 mm.

* * * * *